US007397434B2

(12) United States Patent
Mun et al.

(10) Patent No.: US 7,397,434 B2
(45) Date of Patent: Jul. 8, 2008

(54) BUILT-IN ANTENNA MODULE OF WIRELESS COMMUNICATION TERMINAL

(75) Inventors: Ung Han Mun, Kyungki-do (KR); Jae Suk Sung, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 17 days.

(21) Appl. No.: 11/464,949

(22) Filed: Aug. 16, 2006

(65) Prior Publication Data

US 2007/0063903 A1 Mar. 22, 2007

(30) Foreign Application Priority Data

Sep. 16, 2005 (KR) ..... 10-2005-0086876

(51) Int. Cl.
*H01Q 1/24* (2006.01)

(52) U.S. Cl. ..... 343/702; 343/700 MS

(58) Field of Classification Search ..... 343/702, 343/700 MS, 725
See application file for complete search history.

(56) References Cited

U.S. PATENT DOCUMENTS 5,917,707 A * 6/1999 Khandros et al. ..... 361/776
6,448,932 B1 * 9/2002 Stoiljkovic et al. .... 343/700 MS
6,531,985 B1 * 3/2003 Jones et al. ..... 343/702
2003/0179144 A1 9/2003 Takesako et al.
2006/0145934 A1 * 7/2006 Park et al. ..... 343/702
2008/0001840 A1 * 1/2008 Wong et al. ..... 343/867

FOREIGN PATENT DOCUMENTS

| | | | |
|---|---|---|---|
| EP | 1 677 387 | A1 | 5/2006 |
| GB | 2 391 114 | A | 1/2004 |
| KR | 2004-31805 | A | 4/2004 |
| WO | 02/078123 | A1 | 10/2002 |

OTHER PUBLICATIONS

Korean Intellectual Property Office, Office Action mailed, Nov. 17, 2006.
UK Patent Office Search Report, mailed Dec. 13, 2006.

* cited by examiner

*Primary Examiner*—Tan Ho
(74) *Attorney, Agent, or Firm*—Lowe Hauptman Ham & Berner

(57) ABSTRACT

The invention relates to a built-in antenna for a wireless communication terminal. The built-in antenna includes at least one first radiator for base station and at least one second radiator for Bluetooth. The built-in antenna also includes a base having the first and second radiators mounted on an outer surface thereof. The base is mounted on a board such that each end of the first and second radiators is electrically connected to the board of a terminal body. The built-in antenna further includes a Bluetooth chip set fixed to the base and electrically connected to the second radiator. The invention efficiently utilizes limited space in a terminal body to miniaturize the product, attaining RF capabilities with high reception sensitivity.

13 Claims, 6 Drawing Sheets

BUILT-IN ANTENNA MODULE OF WIRELESS COMMUNICATION TERMINAL

CLAIM OF PRIORITY

This application claims the benefit of Korean Patent Application No. 2005-86876 filed on Sep. 16, 2005, in the Korean Intellectual Property Office, the disclosure of which is incorporated herein by reference.

BACKGROUND OF THE INVENTION

1. Field of the Invention

The present invention relates to an antenna module installed in a wireless communication terminal. More particularly, the invention relates to a built-in antenna module for a wireless communication terminal in which a Bluetooth module is integrated into a structure with an antenna for base station which communicates in a different frequency band from the Bluetooth module, thereby efficiently utilizing a limited space in a miniaturized terminal.

2. Description of the Related Art

In general, a wireless communication terminal refers to a portable communication device capable of transmitting and receiving voices, texts and image data through wireless communication. The examples include a personal communication service (PCS) terminal, a Personal Digital Assistant (PDA), a smart phone, a next-generation mobile communication (IMT-2000) terminal, a wireless Local Area Network (LAN) terminal and the like.

The wireless communication terminal adopts a helical antenna or a dipole antenna to enhance its transmission and reception sensitivity. These are external antennas, which thus are extended out of the wireless terminal.

The external antennas have an advantage of non-directional radiation characteristics. But as they are extended to the outside, they are much likely to be damaged by external force, inconvenient for carrying around, and may be a hindrance to attractive exterior design of the terminal.

To overcome such a problem, planar built-in antennas such as a micro-strip patch antenna or Planar Inverted-F Antenna are adopted in the wireless communication terminal recently since they can be installed in the terminal without being extended outward.

In addition, Bluetooth communication technology is adopted for the terminal to enable sending and receiving wireless data at a transmission rate of 1 M/bit in a short range of about 10 M in a 2.4 Ghz band. In order to conduct the short-range communication using the Bluetooth communication technology, a Bluetooth module needs to be included in a main board of the terminal.

The Bluetooth module is composed of a frequency converter for converting a wire signal to a wireless signal, an amplifier and a Bluetooth antenna.

FIG. 1 is an exploded view illustrating the built-in antenna and the Bluetooth module provided on a board of a terminal according to the prior art. As shown, an antenna module 2 is hooked detachably onto a board 1 of a terminal body (not shown), and a Bluetooth module 10 is mounted on the board 1.

The antenna module 2 includes a pad 3 having a plurality of fastening legs 3*a* corresponding to fastening grooves 1*a* formed on the board 1, a conductor 4 shaped like a metal plate formed on an upper surface of the pad 3, and a feeder 5 extended from the conductor 4 to be inserted into a contact hole 1*b*.

In addition, the Bluetooth module 10 is provided on the board 1 to communicate with electronic devices in a different frequency band from that of the antenna module 2 communicating with the base station. The Bluetooth module 10 includes components such as a wireless circuit, a baseband signal processor, a central processor, an SRAM and a flash device mounted on a module board 11. These components are protected by a shield cover 18, and a Bluetooth antenna 12 is provided at a side of the module board 11 via an input/output electrode 13.

Such a Bluetooth module 10 can be made smaller in accordance with the miniaturization of the terminal by decreasing the number and size of the components contained therein. However, as an additional space is needed for mounting the Bluetooth module 10, there is a limitation in reducing the volume of the terminal when the antenna module 2 and the Bluetooth module 10 are provided on the same plane.

In addition, the Bluetooth module 10 is typically mounted near a lower part of the board 1. This mounting position of the Bluetooth module 10 corresponds to the portion of the terminal held by the hand of the user, which interferes with the RF characteristics of the Bluetooth antenna, thereby degrading the reliability of the terminal.

Therefore, although providing the antenna module 2 and the Bluetooth module 10 together in the terminal body allows an attractive exterior of the terminal and increases portability, there is a limitation in miniaturizing the terminal and in attaining highly sensitive RF capabilities of the antenna.

SUMMARY OF THE INVENTION

The present invention has been made to solve the foregoing problems of the prior art and therefore an object of certain embodiments of the present invention is to provide an antenna module which utilizes a limited space in a terminal body to achieve miniaturization and attain RF capabilities with high reception sensitivity.

According to an aspect of the invention for realizing the object, there is provided a built-in antenna module of a wireless communication terminal including: at least one first radiator for base station; at least one second radiator for Bluetooth; a base having the first and second radiators mounted on an outer surface thereof, the base mounted on a board such that each end of the first and second radiators is electrically connected to the board of a terminal body; and a Bluetooth chip set fixed to the base and electrically connected to the second radiator.

Preferably, each of the first and second radiators comprises a planar antenna that is assembled detachably on an outer surface of the base.

Preferably, each of the first and second radiators comprises an antenna pattern line printed on an outer surface of the base.

Preferably, each of the first and second radiators has a plurality of fixing holes into which a plurality of fixing protrusions formed on an outer surface of the base are fixedly inserted.

Preferably, the first radiator comprises at least one transmission/reception terminal at one end thereof, the transmission/reception terminal having a lower free end that is in contact with and electrically connected to a connection pad of the board.

Preferably, the second radiator comprises at least one transmission/reception terminal at one end thereof, the transmission/reception terminal having a lower free end that is in contact with and electrically connected to a connection pad of the Bluetooth chip set.

Preferably, each of the lower free ends of the transmission/reception terminals is bent to maintain resilient contact with the connection pad.

Preferably, the base has a lower set disposition part having an open bottom for fixedly disposing the Bluetooth chip set.

Preferably, the lower set disposition part has a plurality of resilient protrusions formed on an inner surface thereof for resiliently fixing the Bluetooth chip set.

Preferably, the base has an upper set disposition part having an open top for fixedly disposing the Bluetooth chip set on an upper surface thereof.

Preferably, the upper set disposition part has a plurality of resilient protrusions formed on an inner surface thereof for resiliently fixing the Bluetooth chip set.

Preferably, the base is mounted on an upper area of the board that corresponds to an upper part of the terminal body.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Preferred embodiments of the present invention will now be described in detail with reference to the accompanying drawings.

Figure 1:
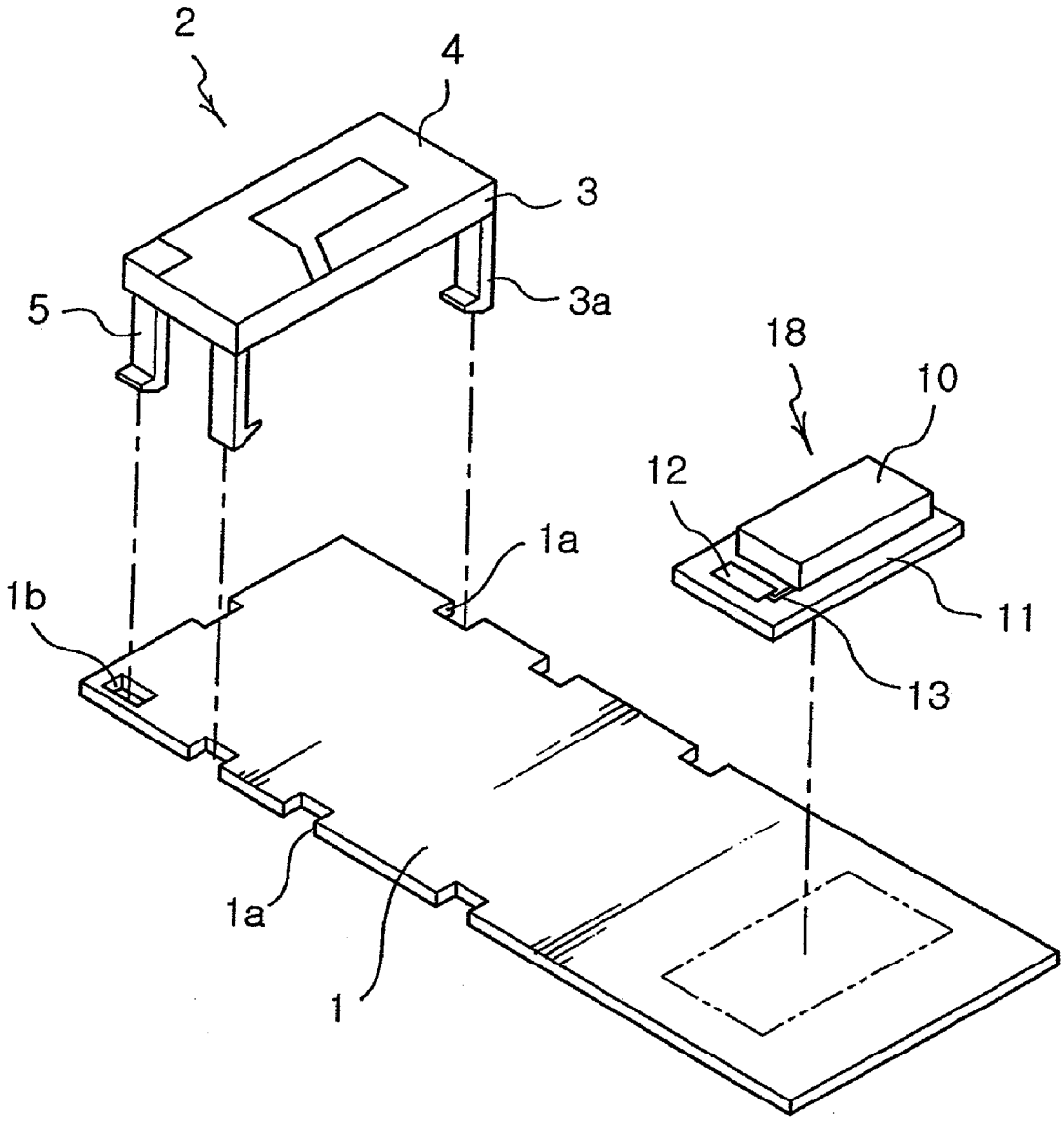
PRIOR ART FIG. 1
FIG. 1 is an exploded view illustrating a built-in antenna and a Bluetooth module provided on a board of a terminal according to the prior art.
Figure 2:
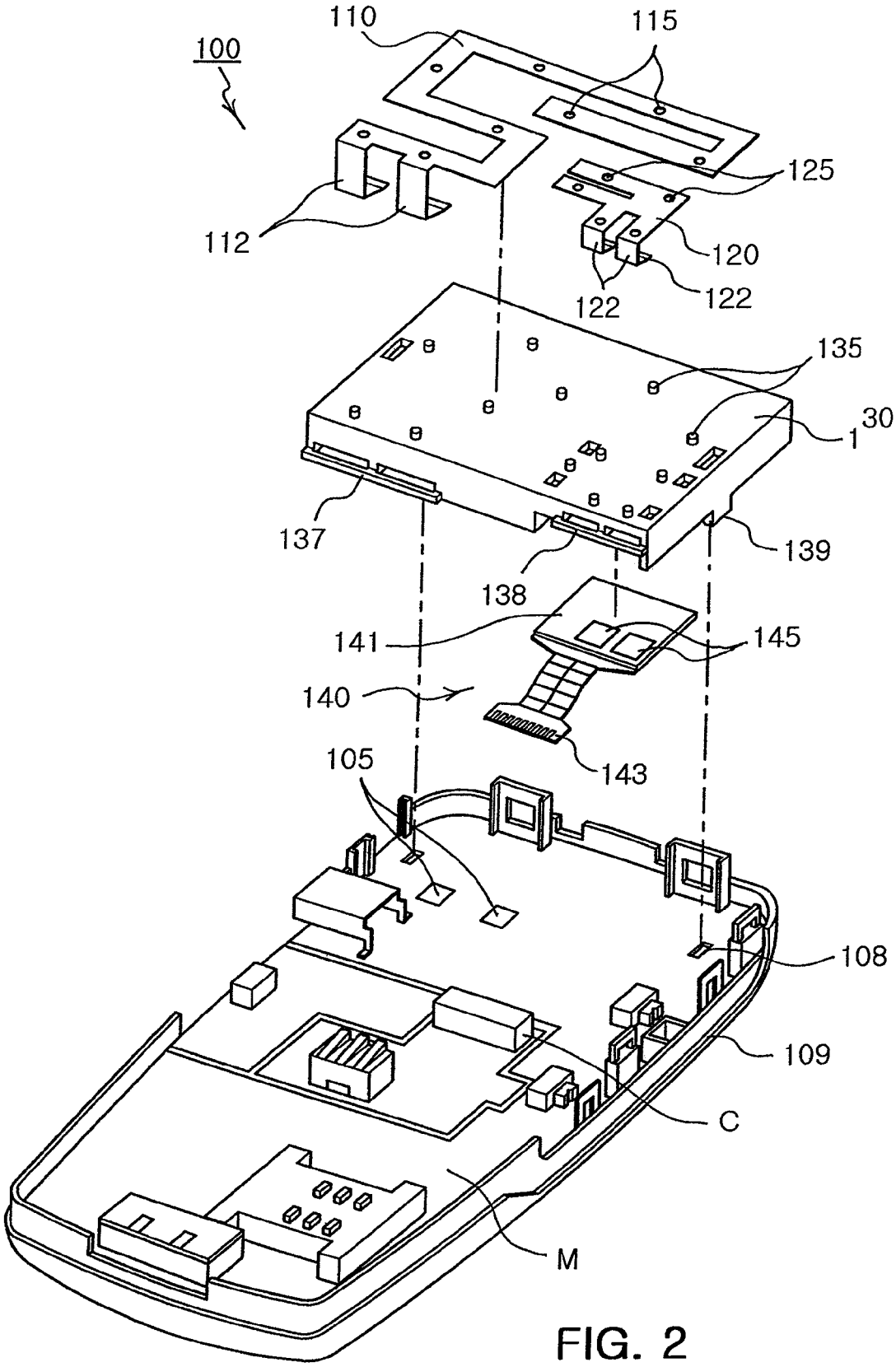
FIG. 2 is an exploded perspective view illustrating a built-in antenna module of a wireless communication terminal according to a first embodiment of the present invention.
Figure 3:
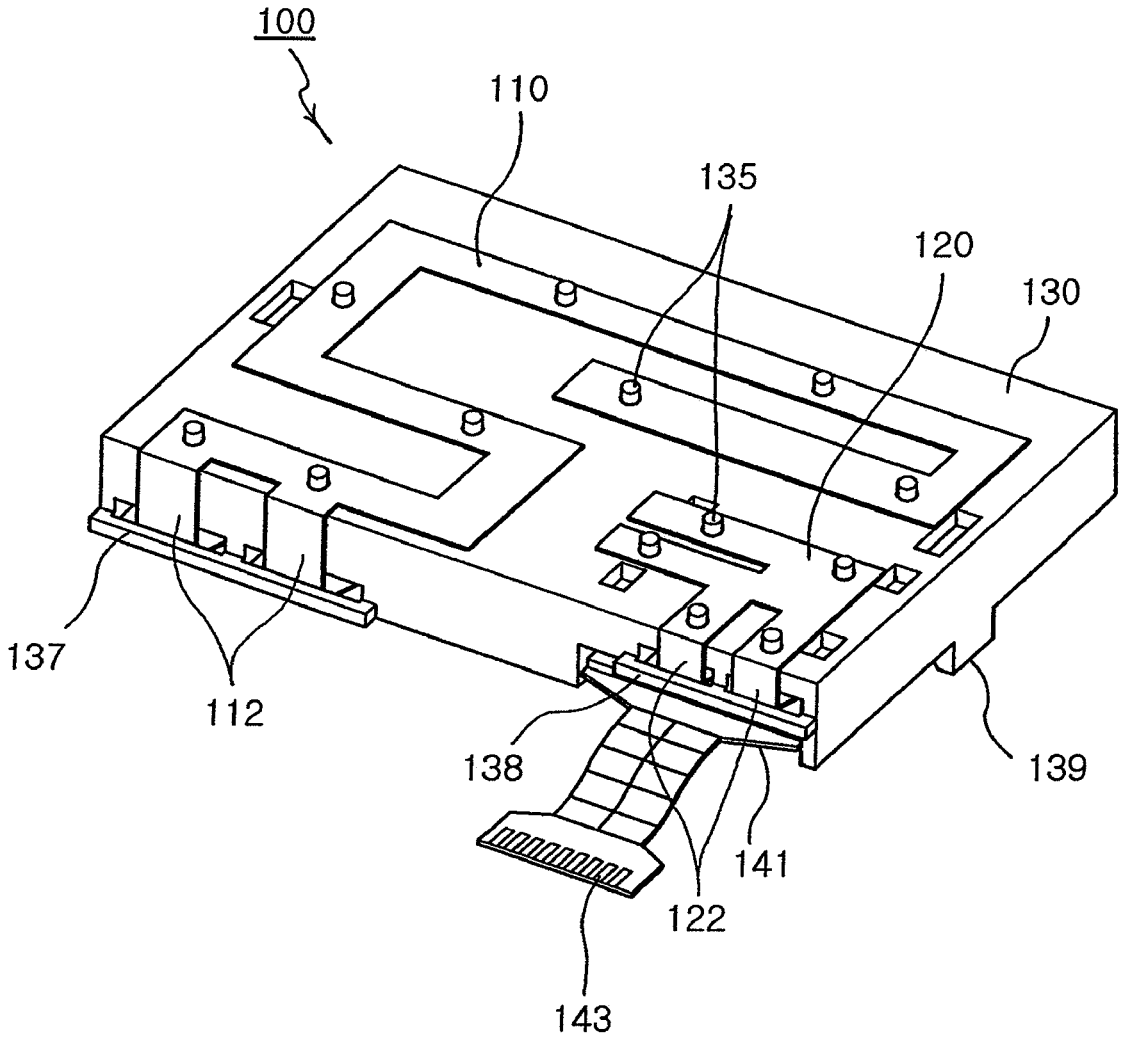
FIG. 3 is a configuration view illustrating the built-in antenna module of the wireless communication terminal according to the first embodiment of the present invention.
Figure 4:
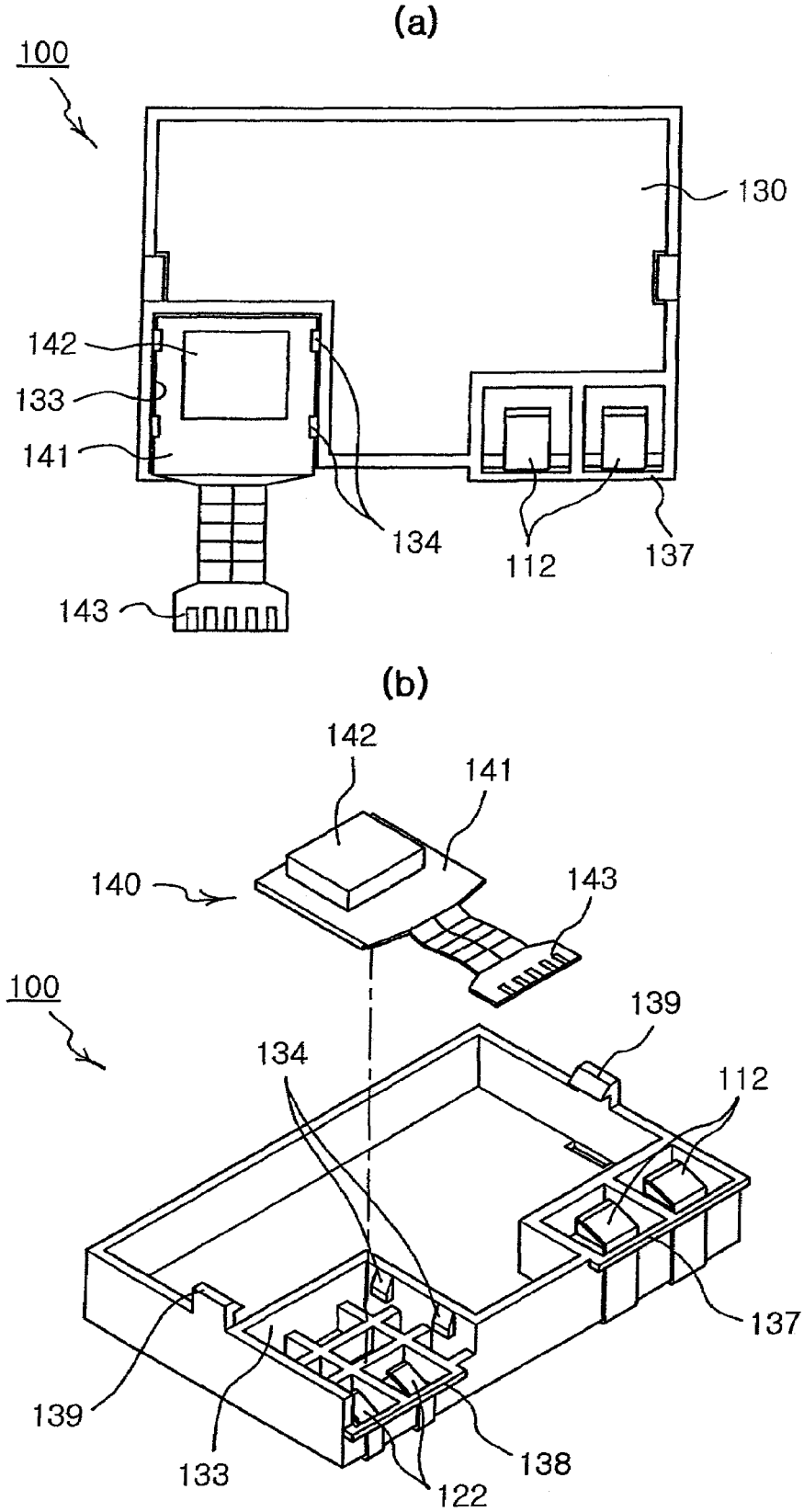
FIG. 4 is a view illustrating the built-in antenna module of the wireless communication terminal according to the first embodiment of the present invention, in which (*a*) is a bottom view and (*b*) is an exploded perspective view of (*a*)

FIG. 2 is an exploded perspective view illustrating a built-in antenna module of a wireless communication terminal according to a first embodiment of the present invention, FIG. 3 is a configuration view illustrating the built-in antenna module of the wireless communication terminal according to the first embodiment of the present invention, and FIG. 4 is a view illustrating the built-in antenna module of the wireless communication terminal according to the first embodiment of the present invention, in which (*a*) is a bottom view and (*b*) is an exploded perspective view of (*a*).

As shown in FIGS. 2 to 4(*a*) and (*b*), the antenna module 100 according to the present invention aims to integrate a Bluetooth module with a structure having an antenna for base station, thereby efficiently utilizing a limited inner space in a wireless communication terminal. The antenna module 100 includes first and second radiators 110 and 120, a base 130 and a Bluetooth chip set 140.

That is, the first and second radiators 110 and 120 are conductors provided on an outer surface of the base 130 such that they can receive an electric signal of a board M provided in a terminal body (not shown), convert the signal to an electric wave, radiate the wave to the outside, and receive an electric wave of a particular frequency band transmitted from the outside during a telephonic communication.

The first and second radiators 110 and 120 are separated. The first radiator 110 is an antenna for base station, which communicates with the base station in a transmission/reception frequency band of about 800 MHz level or 1800 MHz level. The second radiator 120 is a Bluetooth antenna, which communicates with an adjacent electronic device in a transmission/reception frequency band of 2.4 GHz level.

It is preferable that the first and second radiators 110 and 120 provided on an outer surface of the base 130 cover most of the upper surface of the base 130 in order to maximize the transmission/reception capabilities of the antenna.

In addition, the first and second radiators 110 and 120 can selectively adopt a planar antenna such as a micro strip patch antenna or a Planar Inverted-F Antenna, but are not limited thereto. The first and second radiators 110 and 120 can be provided as an antenna pattern line electrically connected to the board M or the Bluetooth chip set 140 by printing a conductive paint on a pre-designed pattern line on a designated portion on an outer surface of the base 130.

One of the various methods of fixing the planar first and second radiators 110 and 120 on an outer surface of the base 130 involves forming a plurality of fixing protrusions 135 on an outer surface of the base 130, and perforating a plurality of fixing holes 115 and 125 corresponding to the fixing protrusions 135 on the first and second radiators 110 and 120.

Therefore, the first and second radiators 110 and 120 can be simply and quickly assembled onto the outer surface of the base 130 by the coupling of each of the fixing protrusions 135 with the fixing holes 115 and 125.

In addition, at least one transmission/reception terminal 112 and 122 is extended from each end of the first and second radiators 110 and 120 along an outer surface of the base 130 and exposed through an under surface of the base 130 facing the board M.

As the Bluetooth chip set 140 is assembled with the base 130, lower free ends of the transmission/reception terminal 112 of the first radiator 110 become in contact with and thus electrically connected to connection pads 105 formed on the board M as the base 130 is assembled with the board M. And lower free ends of the transmission/reception terminal 122 of the second radiator 120 become in contact with and thus electrically connected to another set of connection pads 145 formed on the Bluetooth chip set 140.

At this time, it is preferable that each of the lower free ends of the transmission/reception terminals 112 and 122 of the first and second radiators 110 and 120 is bent so that the lower free ends resiliently contact the connection pads 105 and 145 and stably stay in contact.

In addition, the base 130 is an insulated body injection-molded with a non-conductive resin. The base 130 is assembled detachably onto the board M, having the first and second radiators 110 and 120 attached to an outer surface thereof.

Such a base 130 has a plurality of fixing protrusions 135 protruded on an upper surface thereof corresponding to the fixing holes 115 and 125 of the first and second radiators 110 and 120. The base 130 also has a plurality of hooks 139 formed on a lower surface thereof, which are fitted into assembly holes 108 of the board M. This allows more convenient assembly process of the base 130 having the first and the second radiators 110 and 120 mounted thereon, with the board M, on the assembly line.

The base 130 has slit-shaped first and second guide holes 137 and 138 on an outer surface thereof corresponding to each of the transmission/reception terminals 112 and 122 of the first and second radiators 110 and 120. The first and second guide holes 137 and 138 restraint the movement of the transmission/reception terminals 112 and 122 inserted thereinto.

As shown in FIG. 2, the board M is a printed circuit board which is assembled onto a front surface of a lower casing 109 constituting the terminal body, and which has various electronic components mounted on and various circuits pattern-printed on an upper surface thereof.

In addition, the base 130 has a lower set disposition part 133 provided on a lower surface thereof, which has an open bottom for inserting the Bluetooth chip set 140 from the bottom side. The lower set disposition part 133 has a plurality of resilient protrusions 134 provided on an inner surface thereof which exert resilient force by resiliently contacting and fixing opposed sides of the Bluetooth chip set 140.

Here, as shown in FIGS. 4(*a*) and (*b*), the Bluetooth chip set 140 is fixedly assembled by the resilient protrusions 134 of the lower set disposition part 133, but is not limited thereto. Alternatively, the Bluetooth chip set 140 may have a part of an upper surface thereof bonded to a floor surface of the lower set disposition part 133 by a bonding agent, or may be fastened by fastening members.

In the meantime, the Bluetooth chip set 140 is an electronic device assembled with the base 130 in such a way that it is electrically connected to the transmission/reception terminal 122 of the second radiator 120.

Such a Bluetooth chip set 140 includes a flexible board 141 having chip components such as a wireless circuit, a baseband signal processor, a central processor, an SRAM and a flash device mounted on an upper surface thereof. These chip components are covered by a shield cover 142 which can protect the chip components from inadequate external environment or from harmful electromagnetic radiation.

In addition, the flexible board 141 has connection pads 145 that are connected to the transmission/reception terminals 122 extended from the second radiator 120. The connection pads 145 can comprise a connection terminal printed on a surface of the flexible board 141.

The flexible board 141 has a connector 143 at one end thereof which is inserted into a corresponding connector C provided on the board M, thereby being electrically connected with the board M of the terminal body.

At this time, as shown in FIGS. 2 to 4(*a*) and (*b*), the Bluetooth chip set 140 may be disposed in the lower set disposition part 133 in such a way that its shield cover 142 may face downward, but is not limited thereto. The Bluetooth chip set 140 can also be disposed such that the shield cover 142 faces upward.

Figure 5:
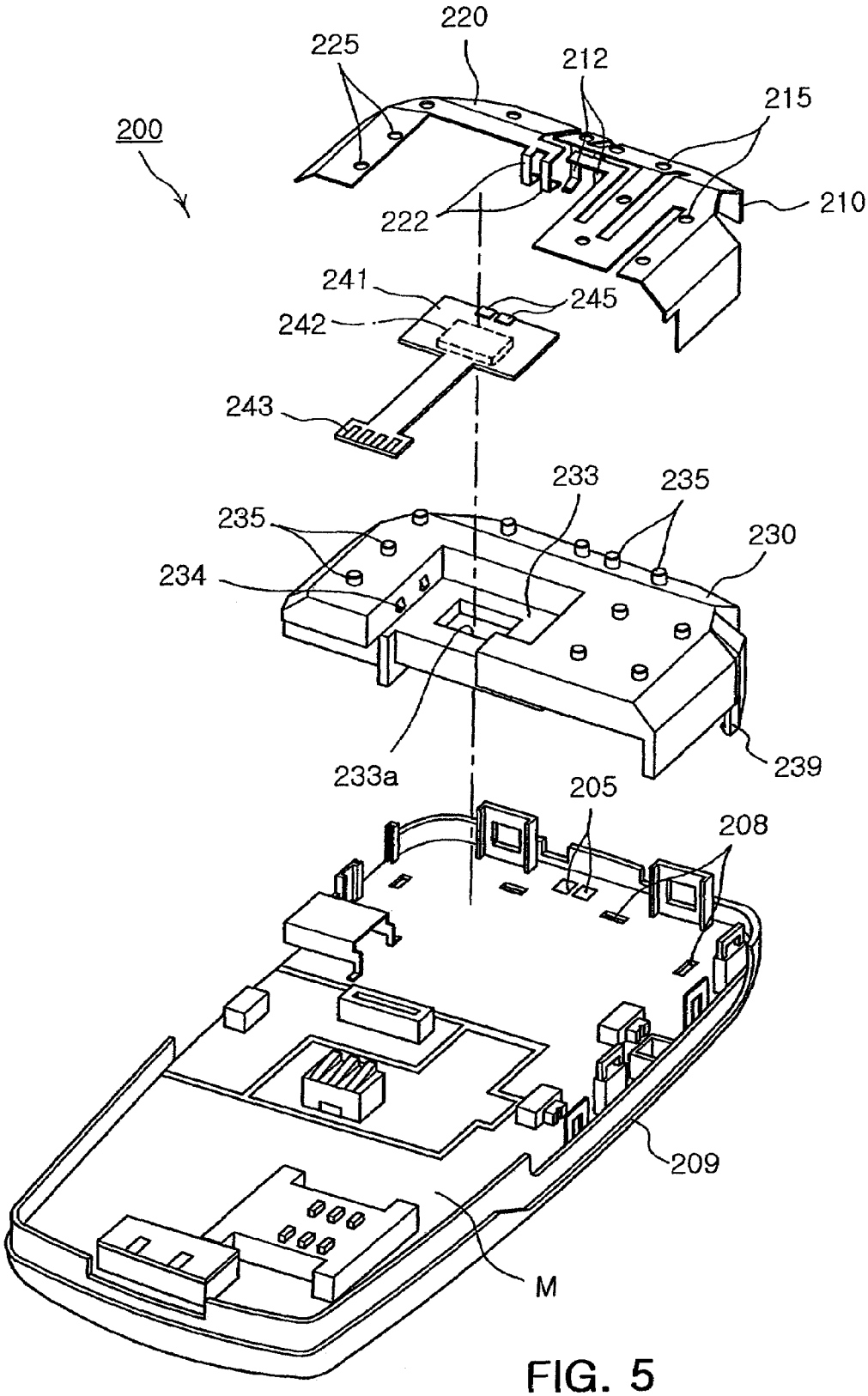
FIG. 5 is an exploded perspective view illustrating a built-in antenna module of the wireless communication terminal according to a second embodiment of the present invention.
Figure 6:
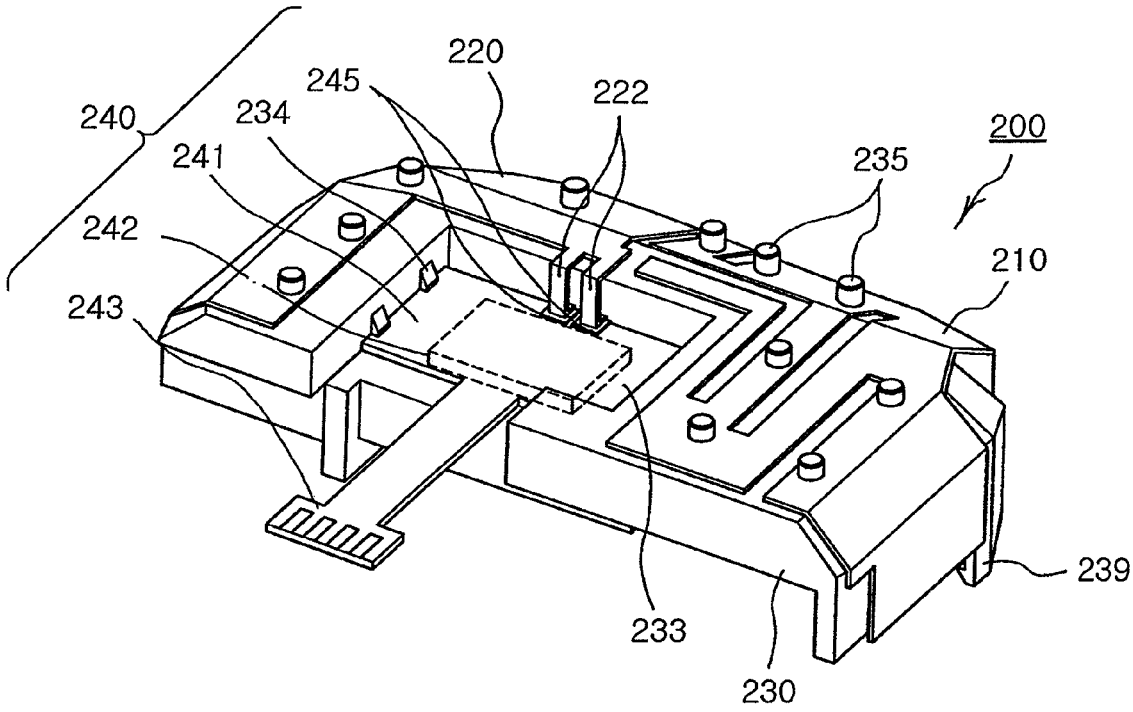
FIG. 6 is a configuration view illustrating the built-in antenna module of the wireless communication terminal according to the second embodiment of the present invention.

FIG. 5 is an exploded perspective view illustrating a built-in antenna module of a wireless communication terminal according to a second embodiment of the present invention, and FIG. 6 is a configuration view illustrating the same. The built-in antenna module 200 of the present invention includes first and second radiators 210 and 220, abase 230 and a Bluetooth chip set 240.

First and second radiators 210 and 220 are applied to a base 230 in the same manner as described hereinabove. Thus a detailed explanation on them is omitted, and related components are given reference numerals in the 200s.

In addition, the base 230 is injection-molded using non-conductive resin likewise with the base in the first embodiment. The base 230 is a structure having the first and second radiators 210 and 220 that are assembled detachably on an outer surface thereof.

The base 230 has a plurality of fixing protrusions 235 formed on an upper surface thereof corresponding to assembly holes 215 and 225 of the first and second radiators 210 and 220. The base 230 also has a plurality of hooks 239 on a lower surface thereof corresponding to assembly holes 208 of the board M.

The base 230 also has an upper set disposition part 233 formed on a portion of the upper surface thereof having the first and second radiators 210 and 220 mounted thereon. The upper set disposition part 233 is recessed in a predetermined depth during the molding of the base and has an open top for seating the Bluetooth chip set 240. The upper set disposition part 233 has a plurality of resilient protrusions 234 on an inner surface thereof for resiliently fixing the Bluetooth chip set 240.

Here, it is also desirable to form a disposition groove 233*a* on a floor surface of the upper set disposition part 233, so that a shield cover 242 of the Bluetooth chip set 240 is disposed in the disposition groove 233*a*.

Here, as shown in FIGS. 5 and 6, the Bluetooth chip set 240 is exemplified by a structure in which it is fixedly assembled by resilient protrusions 234 of the upper set disposition part 233, but is not limited thereto. Alternatively, a part of the lower surface of the Bluetooth chip set 240 may be adhered to the floor surface of the upper set disposition part 233 by a bonding agent, and may be fixedly bound by a binding member.

In addition, likewise with the chip set in the first embodiment, the Bluetooth chip set 240 includes a flexible board 241 having chip components such as a wireless circuit, a baseband signal processor, a central processor, an SRAM and a flash device mounted thereon, the shield cover 242 for protecting the chip parts from external environment, and a connector 243 inserted into and electrically connected to a corresponding connector C on the board M.

The board M has connection pads 205 coupled to lower free ends of a transmission/reception terminal 212 extended from the first radiator 210. The flexible board 241 has another set of connection pads 245 coupled to lower free ends of a transmission/reception terminal 222 extended from the second radiator 220.

Here, as shown in FIGS. 5 and 6, the Bluetooth chip set 240 may be disposed in the upper set disposition part 233 such that the shield cover 242 for protecting the chip components faces downward, but is not limited thereto. Alternatively, the shield cover 242 may face upward and be exposed.

In addition, it is preferable that the base 230, 130 with the first and second radiators 110 and 120, 210 and 220 mounted thereon is mounted on an upper region of the board M which corresponds to an upper part of the terminal body. In this case, when the terminal is used by the user, the portion of the terminal held by the hand of the user does not overlap with the portion where the base 130 is mounted. Thus, transmission and reception of frequency through the first and second radiators 110 and 120, 210 and 220 is not interfered by the hand of the user, thereby preventing degradation of the RF characteristics.

According to the first embodiment as shown in FIGS. 2 and 3, the assembly process of the built-in antenna module 100 involves combining the fixing holes 115 and 125 of the first and second radiators 110 and 120 having the transmission/reception terminals 112 and 122 at one end thereof with the fixing protrusions 135 of the base 130, thereby mounting the first and second radiators 110 and 120 on an outer surface of the base 130.

The transmission/reception terminals 112 and 122 are inserted through the first and second guide holes 137 and 138 of the base 130 so that their low free ends are extended out of a lower part of the base 130.

Subsequently, the Bluetooth chip set 140 is disposed directly under the lower set disposition part 133 of the base 130. With the connection pads 145 of the flexible board 141 facing upward, the chip set 140 is inserted into the lower set disposition part 140. Thus, the chip set 140 is fixed by the resilient protrusions 134, and the connection pads 145 become resiliently in contact with and electrically connected to the lower free ends of the transmission/reception terminal 122 of the second radiator 120.

In addition, the hooks 139 of the base 130, having the first and second radiators 110 and 120 and the Bluetooth chip set 140 mounted thereon, are inserted into the assembly holes 108 of the board M. Thereby, the base 130 is mounted on the board M, and at the same time, the transmission/reception terminal 112 of the first radiator 110 becomes resiliently in contact with and electrically connected to the connection pads 105 of the board M.

In addition, the connector 143 extended from the flexible board 141 of the chip set 140 is connected to the corresponding connector C of the board M, thereby electrically connecting the chip set 140 and the board M.

According to a second embodiment of the invention as shown in FIGS. 5 and 6, the assembly process of the built-in antenna module 200 involves disposing the Bluetooth chip set 240 directly on the upper set disposition part 233 on an upper surface of the base 230. Then, with the connection pads 245 facing upward, the chip set 240 is inserted into the upper set disposition part 233. As a result, the chip set 240 is fixed by the resilient protrusions 234 while the shield cover 242 of the flexible board 241 is inserted and disposed in the disposition groove 233*a*.

Subsequently, as described hereinabove, the first and second radiators 210 and 220 are respectively mounted onto an outer surface of the base 230 having the chip set 240 disposed thereon by combining the fixing holes 215 and 225 with the fixing protrusions 235.

At this time, the lower free ends of the transmission/reception terminal 222 of the second radiator 220, which extends out of a lower part of the base 230 becomes resiliently in contact with and electrically connected to the connection pads 245 of the flexible board 241.

In addition, as the base 230 having the first and second radiators 210 and 220 and the Bluetooth chip set 240 mounted thereon is mounted on the board M, the transmission/reception terminal 212 of the first radiator 210 becomes resiliently in contact with and electrically connected to the connection pads 205 of the board M, and the connector 243 extended from the flexible board 241 is connected to the corresponding connector C of the board M, thereby electrically connecting the chip set 240 and the board M.

According to the present invention set forth above, a Bluetooth chip set is provided on a base having a radiator for base station and a radiator for Bluetooth. Thus, at least two radiators transmitting and receiving in different frequency bands and at least one chip set are integrated in a single module, thereby efficiently utilizing the limited inner space in a terminal body and miniaturizing a terminal without degrading transmission and reception capabilities of an antenna.

In addition, the base with a plurality of radiators provided thereon is mounted on an upper region of a board which corresponds to an upper part of the terminal body so that the portion of the terminal held by the hand of the user does not overlap with the portion where the base is mounted, thus preventing degradation of RF capabilities of the radiators and stably maintaining antenna characteristics, thereby enhancing the reliability of the terminal.

While the present invention has been shown and described in connection with the preferred embodiments, it will be apparent to those skilled in the art that modifications and variations can be made without departing from the spirit and scope of the invention as defined by the appended claims.

What is claimed is:

1. A built-in antenna module of a wireless communication terminal comprising:

at least one first radiator for base station;

at least one second radiator for Bluetooth;

a base having the first and second radiators mounted on an outer surface thereof, the base mounted on a board such that each end of the first and second radiators is electrically connected to the board of a terminal body;

a recess provided in a portion of the base; and a Bluetooth chip set accommodated in the recess and fixed to the base and electrically connected to the second radiator.

2. The built-in antenna module of a wireless communication terminal according to claim 1, wherein each of the first and second radiators comprises a planar antenna that is assembled detachably on an outer surface of the base.

3. The built-in antenna module of a wireless communication terminal according to claim 1, wherein each of the first and second radiators comprises an antenna pattern line printed on an outer surface of the base.

4. The built-in antenna module of a wireless communication terminal according to claim 1, wherein each of the first and second radiators has a plurality of fixing holes into which a plurality of fixing protrusions formed on an outer surface of the base are fixedly inserted.

5. The built-in antenna module of a wireless communication terminal according to claim 1, wherein the first radiator comprises at least one transmission/reception terminal at one end thereof, the transmission/reception terminal having a lower free end that is in contact with and electrically connected to a connection pad of the board.

6. The built-in antenna module of a wireless communication terminal according to claim 5, wherein the lower free end of the at least one transmission/reception terminal is bent to maintain resilient contact with the connection pad.

7. The built-in antenna module of a wireless communication terminal according to claim 1, wherein the second radiator comprises at least one transmission/reception terminal at one end thereof, the transmission/reception terminal having a lower free end that is in contact with and electrically connected to a connection pad of the Bluetooth chip set.

8. The built-in antenna module of a wireless communication terminal according to claim 7, wherein the lower free end of the at least one transmission/reception terminal is bent to maintain resilient contact with the connection pad.

9. The built-in antenna module of a wireless communication terminal according to claim 1, wherein the recess is a lower set disposition part having an open bottom for fixedly disposing the Bluetooth chip set.

10. The built-in antenna module of a wireless communication terminal according to claim 9, wherein the lower set disposition part has a plurality of resilient protrusions formed on an inner surface thereof for resiliently fixing the Bluetooth chip set.

11. The built-in antenna module of a wireless communication terminal according to claim 1, wherein the recess is an upper set disposition part having an open top for fixedly disposing the Bluetooth chip set on an upper surface thereof.

12. The built-in antenna module of a wireless communication terminal according to claim 11, wherein the upper set disposition part has a plurality of resilient protrusions formed on an inner surface thereof for resiliently fixing the Bluetooth chip set.

13. The built-in antenna module of a wireless communication terminal according to claim 1, wherein the base is mounted on an upper area of the board that corresponds to an upper part of the terminal body.

* * * * *